US005706570A

United States Patent [19]

Inoue et al.

[11] Patent Number: 5,706,570

[45] Date of Patent: Jan. 13, 1998

[54] TERMINAL CRIMPING DEVICE

[75] Inventors: Toshihiro Inoue; Akira Sugiyama, both of Shizuoka, Japan

[73] Assignee: Yazaki Corporation, Toyko, Japan

[21] Appl. No.: 642,286

[22] Filed: May 3, 1996

[30] Foreign Application Priority Data

May 12, 1995 [JP] Japan ..... 7-114326

[51] Int. Cl.[6] ..... H01R 43/04; B21J 7/46

[52] U.S. Cl. ..... 29/566.2; 29/753; 72/448

[58] Field of Search ..... 29/33 M, 566.1, 29/566.2, 566.3, 753, 564.6; 72/446, 448

[56] References Cited

U.S. PATENT DOCUMENTS 3,911,721 10/1975 Baldyga ..... 29/33 M X

FOREIGN PATENT DOCUMENTS 575077 4/1959 Canada ..... 29/753

55-75990 5/1980 Japan .

59-33689 3/1984 Japan .

5-55992 8/1993 Japan .

*Primary Examiner*—William R. Briggs

*Attorney, Agent, or Firm*—Armstrong, Westerman, Hattori, McLeland & Naughton

[57] ABSTRACT

A terminal crimping unit includes a unit case and a crimping machine assembly removable from the unit case. The crimping machine assembly includes a mounting block provided with a base plate, an anvil provided on anvil mounting stand on the base plate; a ram assembly arranged vertically movably above said anvil and provided with a crimper on its front surface; a terminal feed portion for intermittently feeding the side feed terminal chain, located beside the ram assembly; an anvil rotating means for reciprocatively rotating the anvil mounting stand between a terminal crimping position below said ram assembly and a terminal delivery position at the tip of said terminal feed portion; and a cut/separation means, located above the terminal delivery position, for separating an individual terminal from said side feed terminal chain intermittently fed.

9 Claims, 10 Drawing Sheets

TERMINAL CRIMPING DEVICE

BACKGROUND OF THE INVENTION

1. Field of the Invention

The present invention relates to a terminal crimping device using a side feed terminal chain, and more particularly to a terminal crimping device which is configured as a crimping machine assembly or a terminal crimping unit like that for a vertical feed terminal chain. These terminal crimping machines for the side feed terminal chain and vertical feed terminal chain can be exchanged as required, thus saving space.

2. Description of the Prior Art

As well known, a wire harness includes a great number of wires, and various kinds of terminals are crimped on the ends of the respective wires according to wire capacity, male or female. Since different terminals has different crimping conditions, one crimping machine has been used for one part number of terminal.

FIG. 8 shows an automatic terminal crimping device using the conventional terminal crimping machine (Japanese Patent Publn. 5-55992). In this automatic crimping device, with plural crimping machines $82_1$, $82_2$, $82_3$, . . . being arranged in parallel on a stand 81, plural wires 85 held in parallel oppositely to these crimping machines at predetermined intervals by plural wire clips 84 of a wire clamp rod 83 are moved simultaneously with a predetermined crimping machine, and when the terminal of the wire reaches a desired terminal crimping machine, a predetermined terminal is crimped.

In the figure, reference numeral 86 denotes a wire correcting device for removing warp of the wire; 87 a device for stripping the coating of the wire; $82_1$, $82_2$, $82_3$, . . . connector housings each for inserting the crimping terminal of a wire terminal; and 89 a head for terminal transfer.

The terminal for crimping includes two kinds of terminals inclusive of side feed terminal chain 91 (FIG. 9A) and a vertical feed terminal chain 92 (FIG. 9B).

As shown in FIG. 8, since the automatic terminal crimping device moves wirings in a predetermined single direction, the plural crimping machines must be arranged in a row regardless with the side feed or vertical feed of terminals.

Where the side feed terminal chain 91 is used, as shown in FIG. 10A, since the terminal crimping machine 93 is provided with a terminal feed space 95 and a part 96 for assisting the terminal feed, which are separate from a terminal crimping portion 94, its width is 3–5 times as long as that of the terminal crimping machine 97 for the vertical feed of terminals as shown in FIG. 10B. For this reason, the entire automatic crimping device requires a vast space for accommodating plural terminal crimping machines. In addition, it is difficult to modify the terminal crimping machine once set up for the vertical feed of terminals into that for side feed of terminals. This is a serious obstacle against automation of terminal crimping.

SUMMARY OF THE INVENTION

In view of the problems as described above, an object of the present invention is to provide a terminal crimping machine assembly which can crimp side feed terminals in a relatively narrow space as in the vertical feed terminal chain.

Another object of the present invention is to provide a terminal crimping units for vertical feed and side feed of terminals, which can be easily replaced by each other as required, thereby greatly saving space for the automatic terminal crimping device.

In order to attain the above object, there is provided a terminal crimping machine assembly for a side feed terminal chain composed of terminals connected at a predetermined pitch through a coupling pieces on one side of a carrier strip, comprising: a mounting block provided with a base plate; an anvil provided on anvil mounting stand on the base plate; a ram assembly arranged vertically movably above said anvil and provided with a crimper on its front surface; a terminal feed portion for intermittently feeding said side feed terminal chain, located beside said ram assembly; an anvil rotating means for reciprocatively rotating said anvil mounting stand between a terminal crimping position below said ram assembly and a terminal delivery position at the tip of said terminal feed portion; and a cut/separation means, located above said terminal delivery position, for separating an individual terminal from said side feed terminal chain intermittently fed.

In accordance with the present invention, since the terminal feed portion for the side feed terminal chain is in a vertical direction but not in a transverse direction for the crimper and anvil and the terminal intermittently fed and cut away is rotated between the terminal delivery position and a terminal crimping position, the terminal crimping machine for a side feed terminal chain can be fabricated in a narrow form like the conventional terminal crimping machine for vertical feed terminal chain, thereby saving space for the terminal crimping device.

The above and other objects and features of the present invention can be more apparent from the following description taken in conjunction with the accompanying drawings.

DESCRIPTION OF THE PREFERRED EMBODIMENTS

Figure 1:
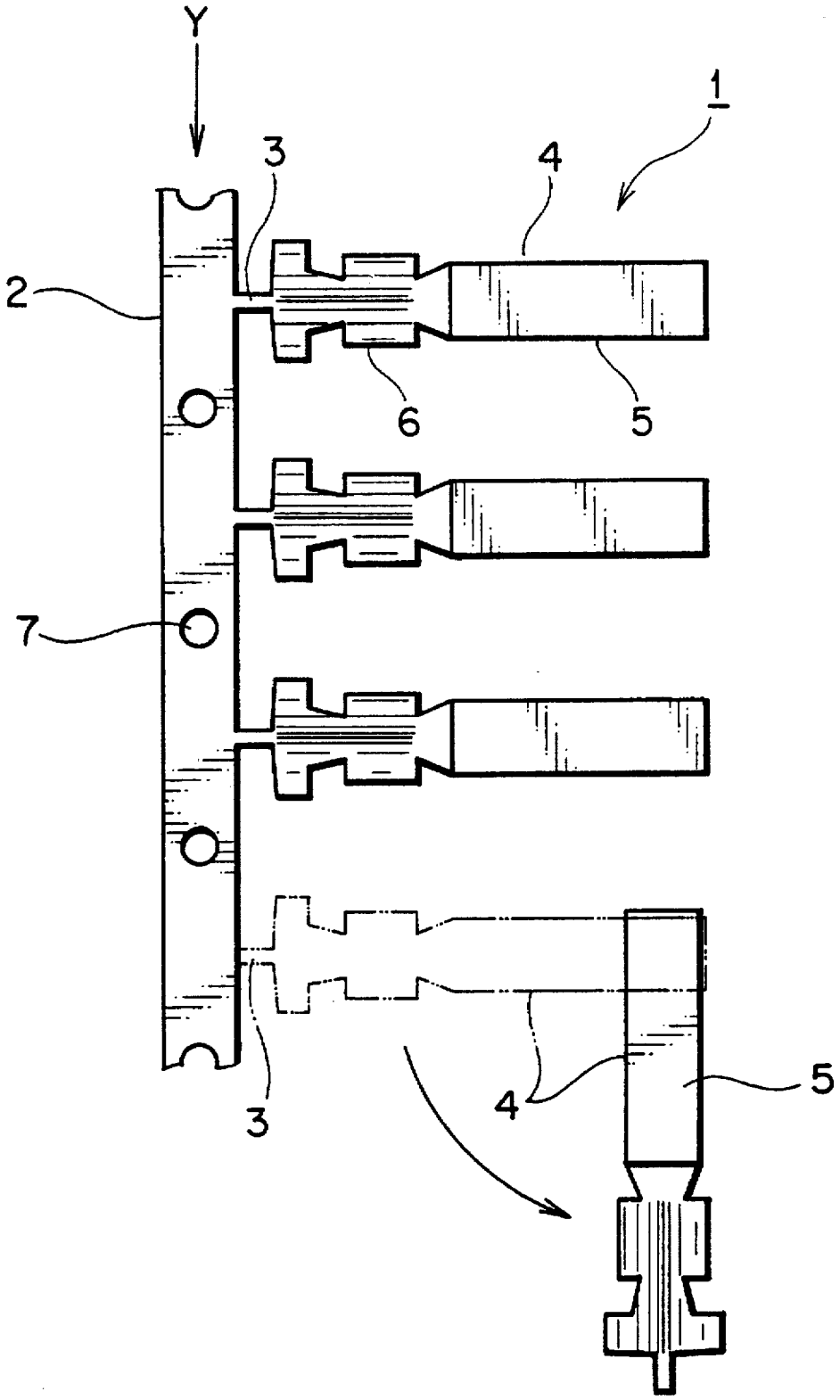
FIG. 1 is a view for explaining the basic operation of a crimping machine assembly according to the present invention.

FIG. 1 is a view for explaining the basic operation of a crimping machine assembly according to the present invention. In operation, after a side feed terminal chain, generally 1, is moved intermittently in a direction of carrier 2 as indicated by arrow Y, a coupling piece 3 is cut to separate an individual terminal 4. Around the electrical contact portion 5 of the terminal, its wire connecting portion 6 is rotated by about 90° towards the direction of supplying the carrier so that the axis of terminal is aligned with the longitudinal direction of the carrier. Thereafter, the terminal is crimped onto a wire. Specifically, in the prior art, intermittent movement and cut/separation of the terminal and crimping of the terminal were performed simultaneously, whereas in the present invention, the cut/separation and crimping of the terminal are separately performed. Incidentally, in FIG. 1, reference numeral 1 denotes a terminal feed hole. Although the terminal 4 as shown is a female terminal, it may be a male terminal.

Figure 2:
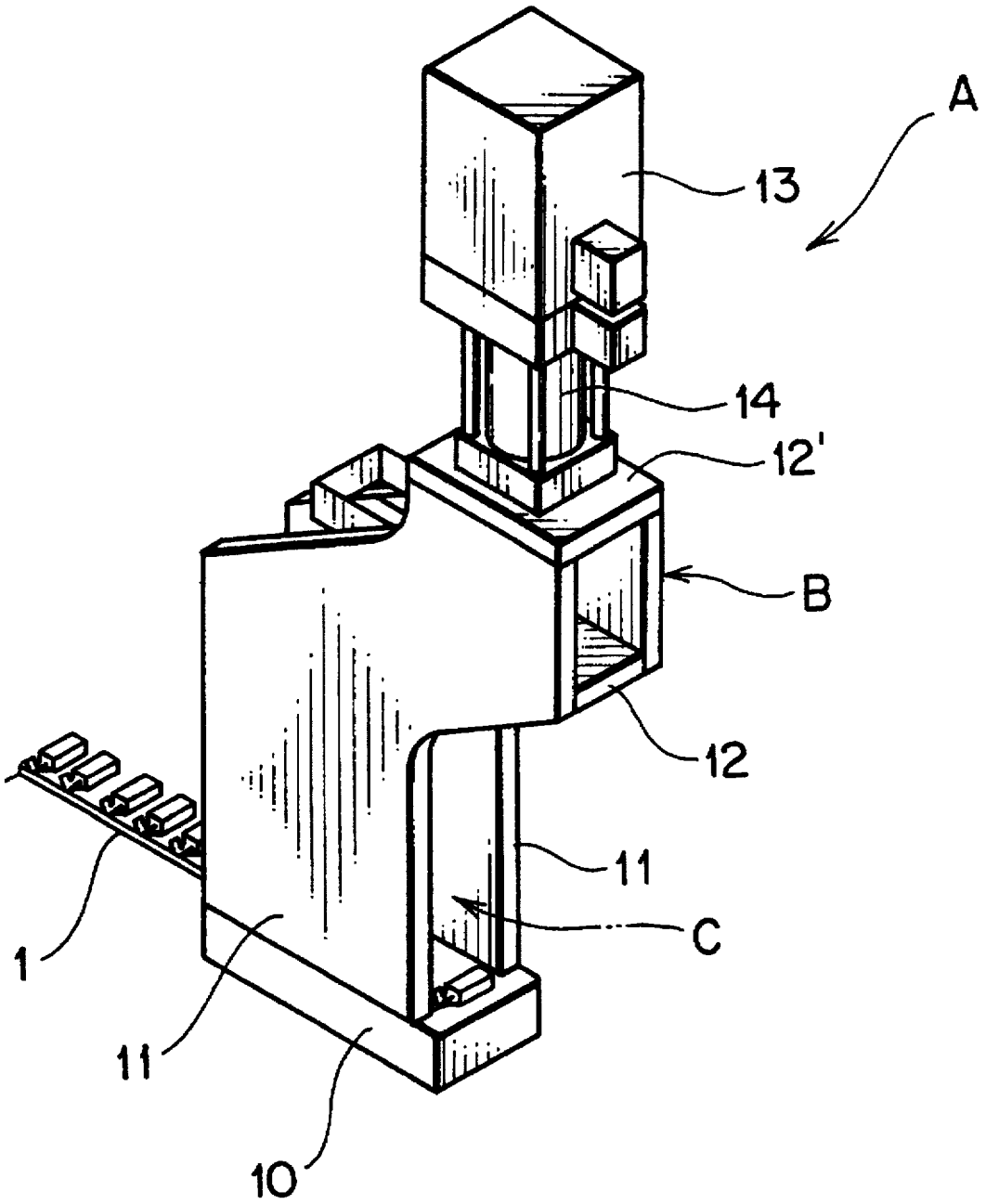
FIG. 2 is a schematic perspective view of one embodiment of the crimping unit A according to the present invention.

FIG. 2 is a schematic perspective view of a terminal crimping unit A according to the present invention. The terminal crimping unit A includes a unit case B and a terminal crimping assembly C. The terminal crimping assembly C is removably attached to the unit case B.

Figure 10A:
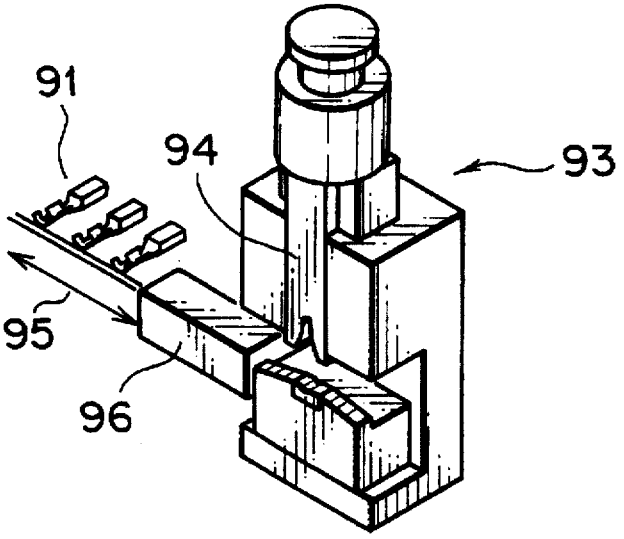
FIG. 10A PRIOR ART
FIGS. 10A and FIG. 10B are views for explaining the prior art terminal crimping machine for side feed terminal chain and longitudinal feed terminal chain, respectively.
Figure 10B:
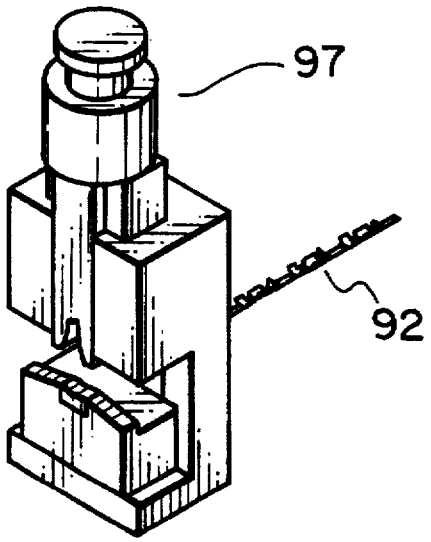
FIG. 10B PRIOR ART

The terminal crimping assembly C as shown is dedicated to the side feed terminal. The crimping machine assembly for the vertical feed terminal chain can be diverted from the conventional terminal crimping assembly for the longitudinal feed terminal shown in FIG. 10B and its modification.

Figure 3:
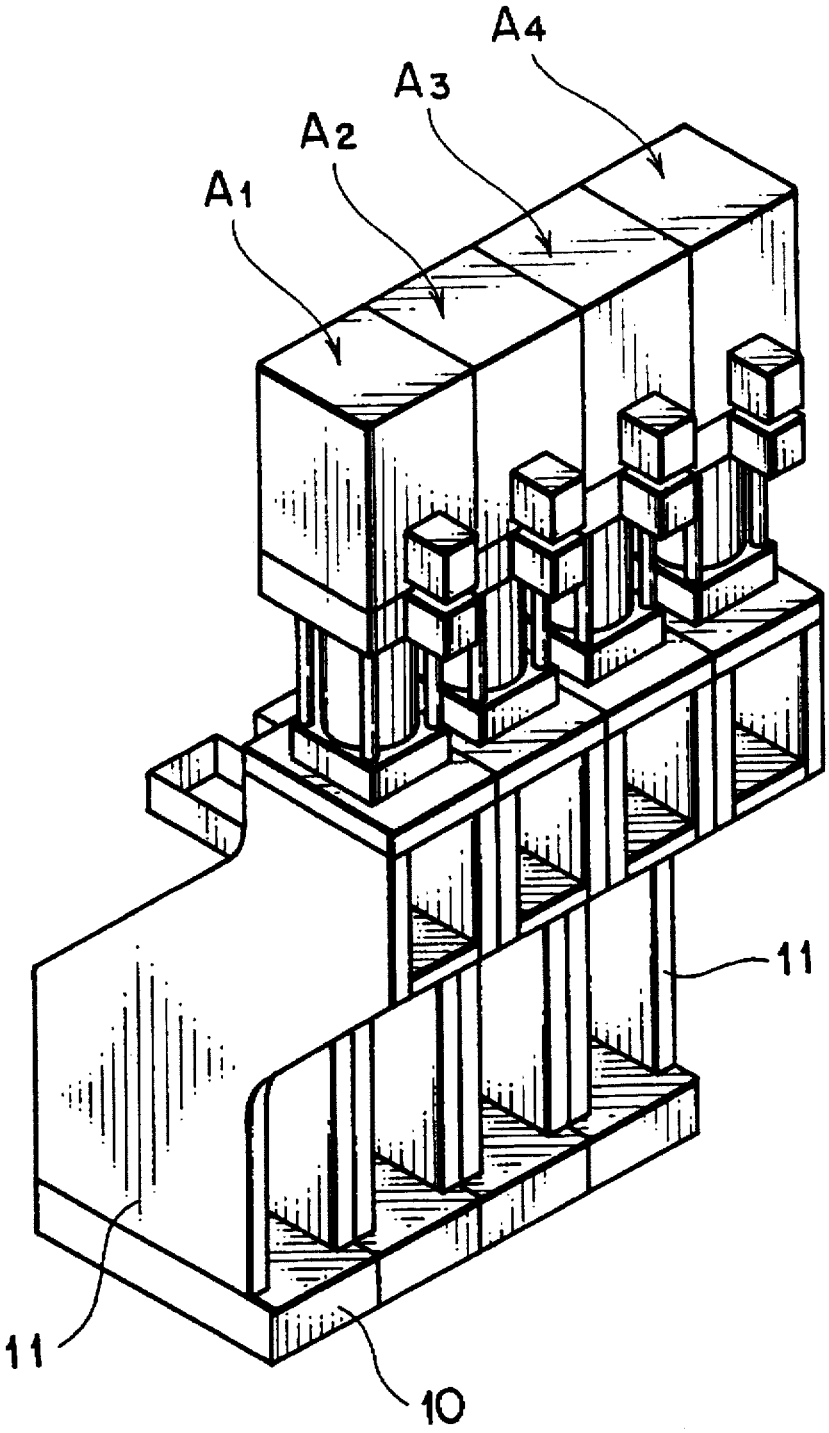
FIG. 3 is a view for explaining an automatic terminal crimping device including plural crimping units of FIG. 2 arranged in a row.

FIG. 3 shows the state where plural terminal units $A_1$, $A_2$, $A_3$, $A_4$, . . . are arranged in a row. In the figure, units $A_1$, $A_3$, . . . with odd numbers are dedicated to the side feed terminal chain, and $A_2$, $A_4$, . . . with even numbers the vertical feed terminal chain. The terminal crimping units $A_1$, $A_3$, . . . for the side feed terminal chain according to the present invention can use the same unit case B as for the terminal crimping units $A_2$, $A_4$, . . . for the vertical feed terminal chain. This can save the space for the entire automatic terminal crimping device.

Figure 6:
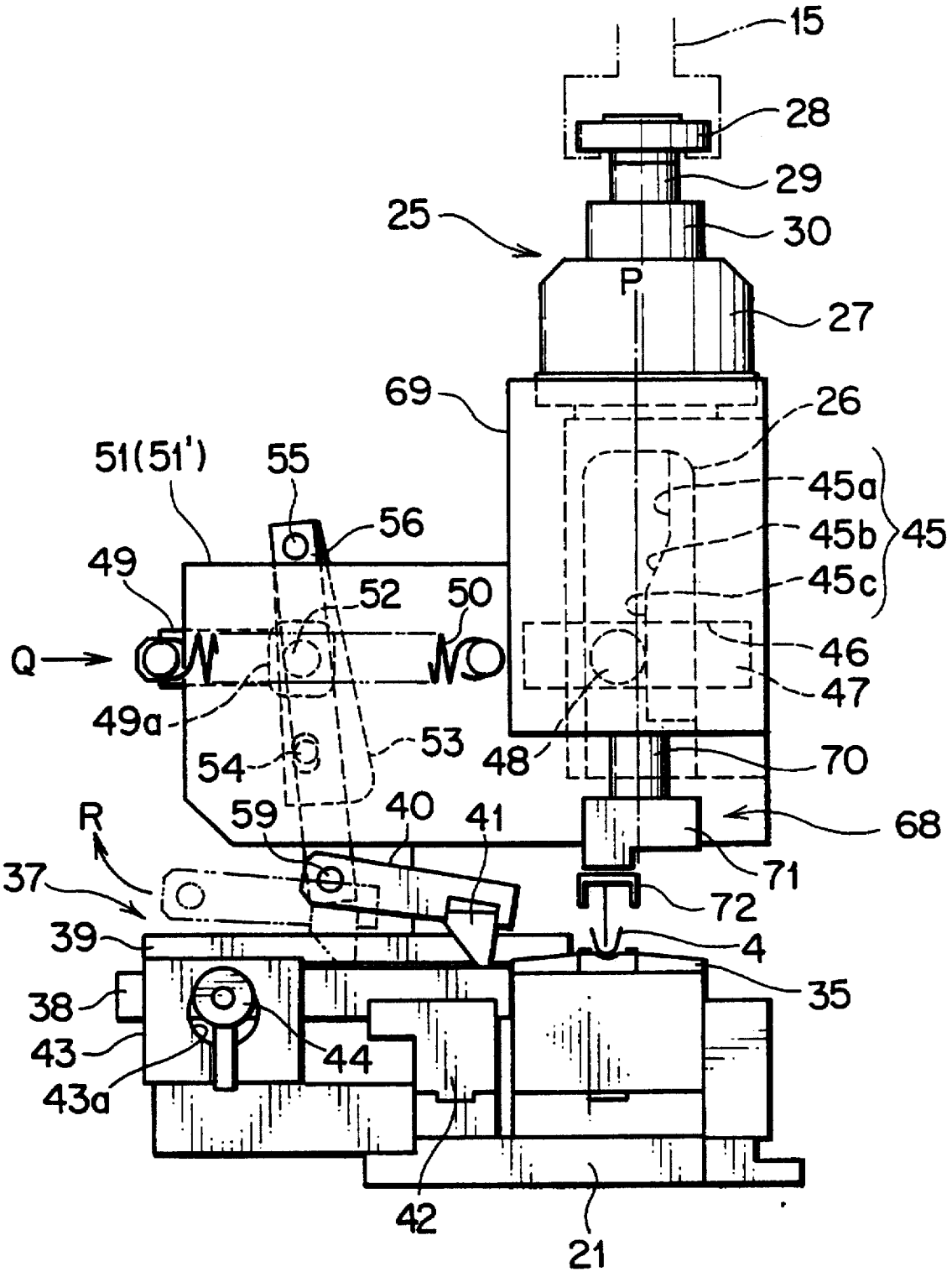
FIG. 6 is a left side view of FIG. 4.

Returning to FIG. 2, the unit case B includes a bottom plate 10, side plates 11 on the sides thereof and top plates 12, 12'. An air cylinder 13 serving as an actuator is substantially centrally fixed to the top plate 12'. Its pin rod 14 protrudes downwards and its tip is provided with a joint member 16 as shown in FIG. 6.

Figure 4:
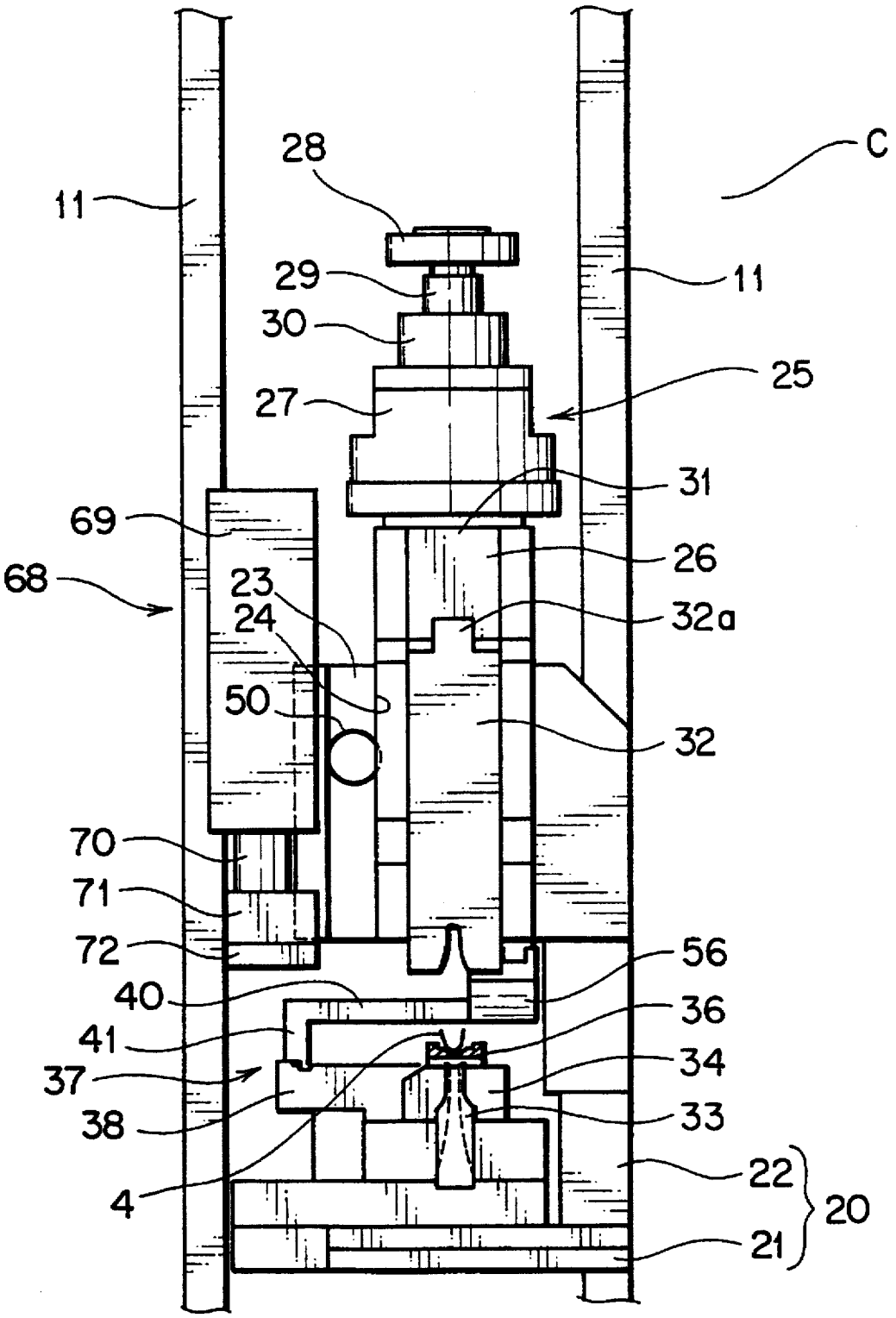
FIG. 4 is a front view of a crimping machine assembly C constituting the crimping unit according to the present invention.
Figure 5:
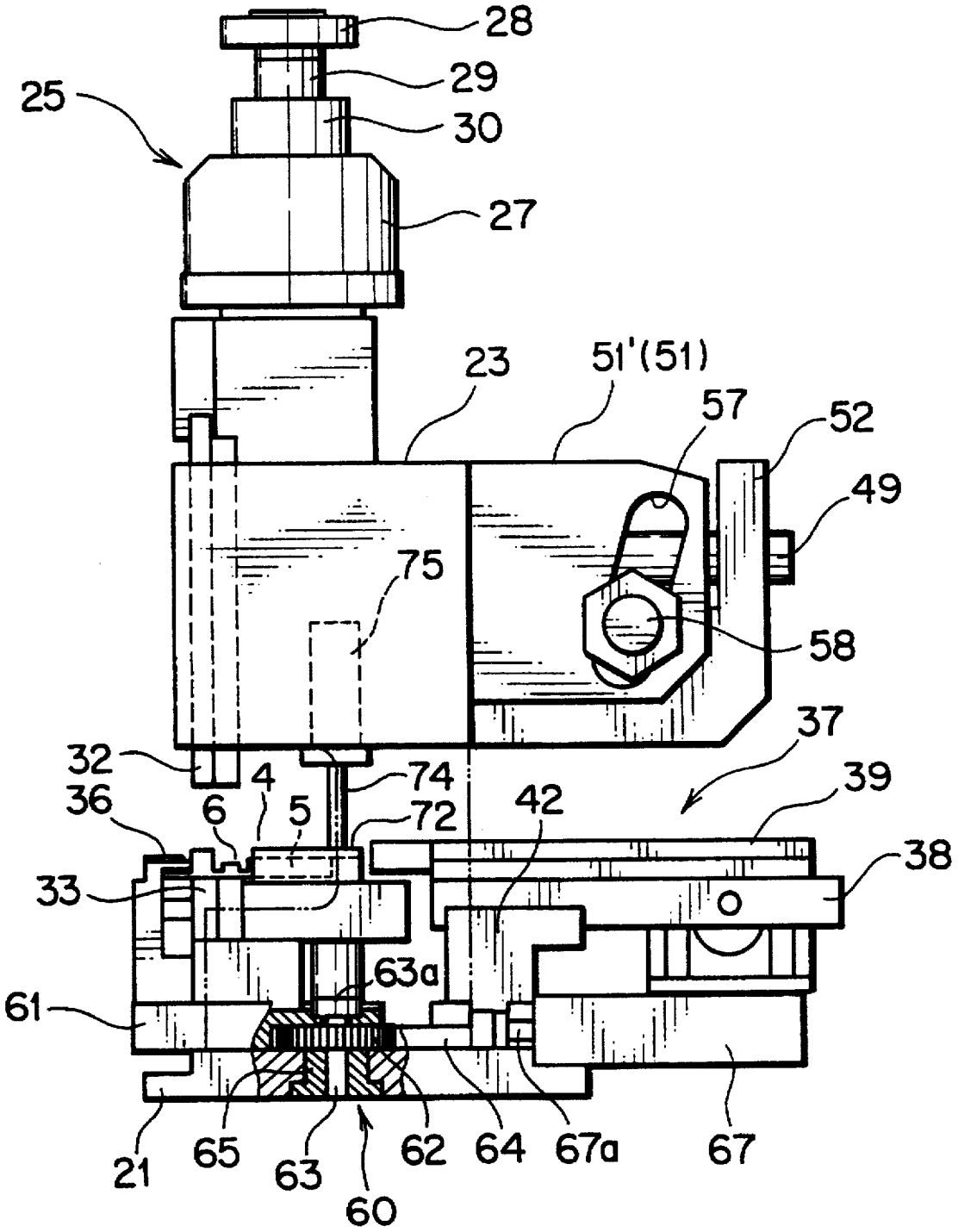
FIG. 5 is a right side view partially broken in FIG. 4.
Figure 7A:
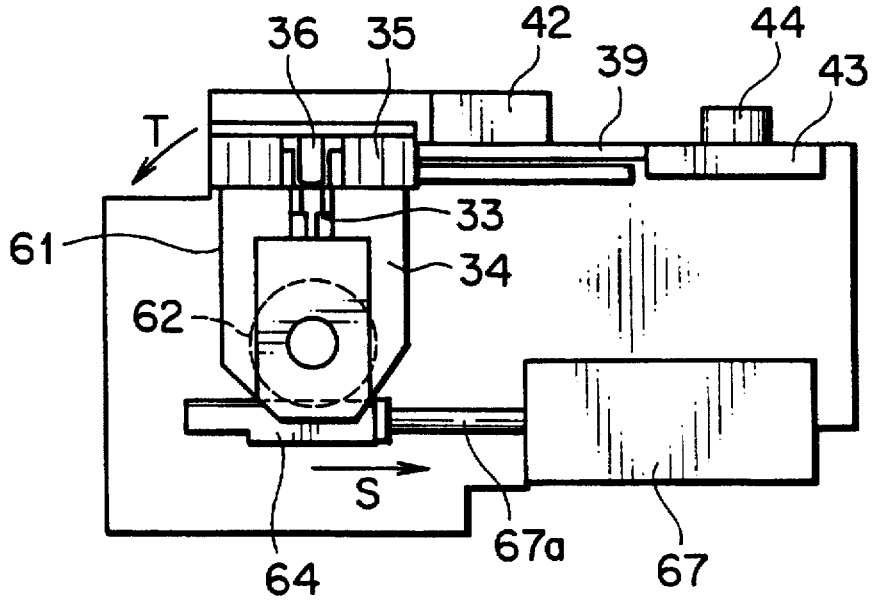
FIGS. 7A and 7B are plan views of the states where an anvil attaching stand is located on a terminal delivery position and a terminal crimping position, respectively.
Figure 7B:
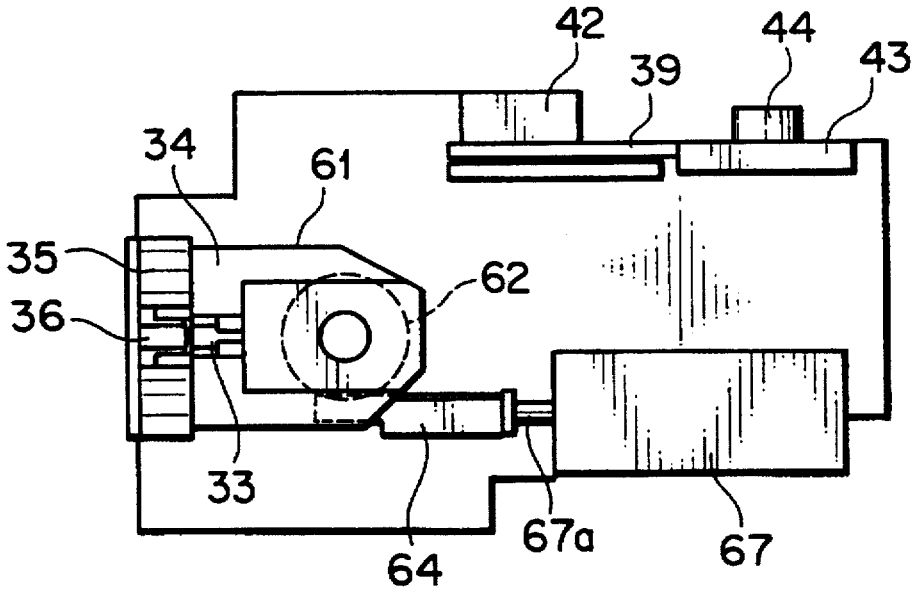
Figure 8:
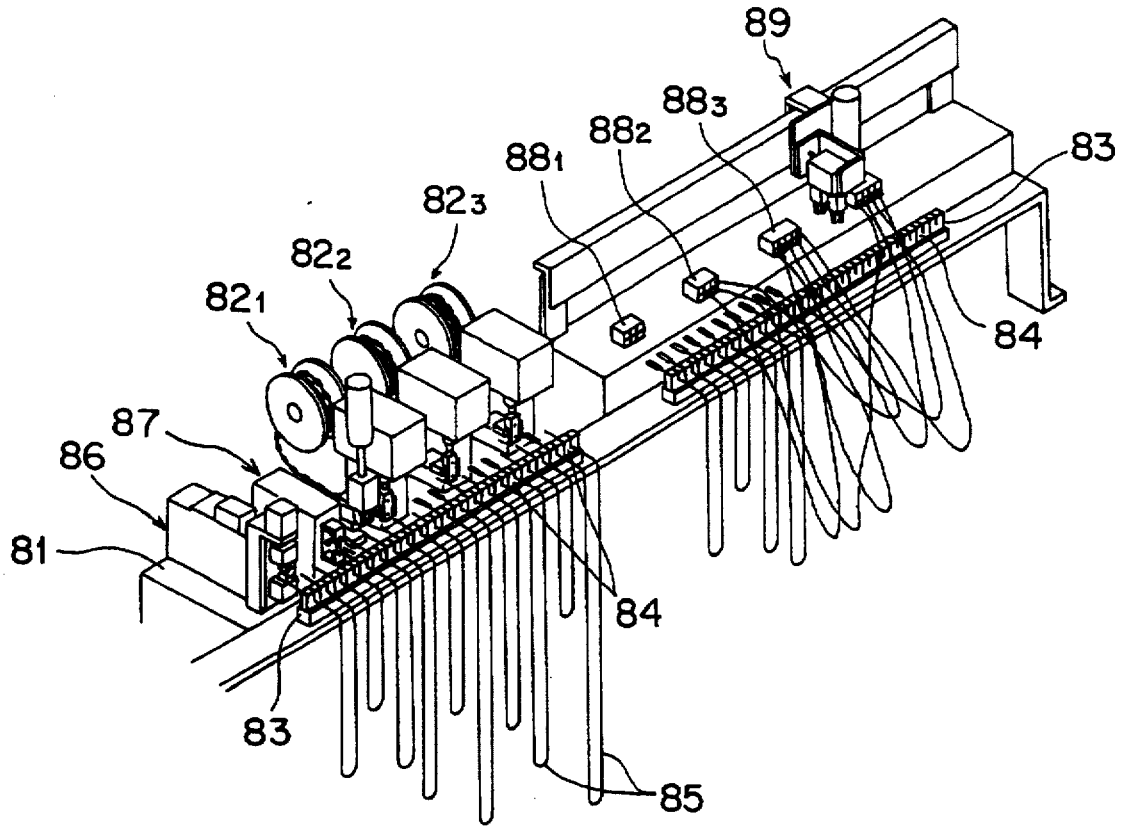
FIG. 8 is a view for explaining the prior art conventional terminal crimping device.
Figure 9A:
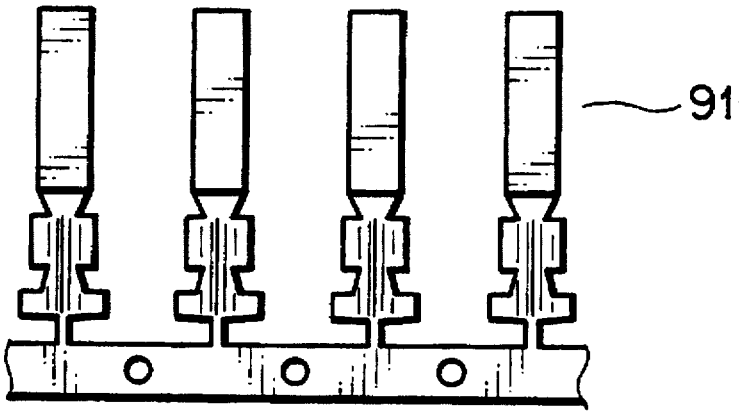
FIGS. 9A and 9B are views showing a conventional side feed terminal chain and a vertical feed terminal, respectively.
Figure 9B:
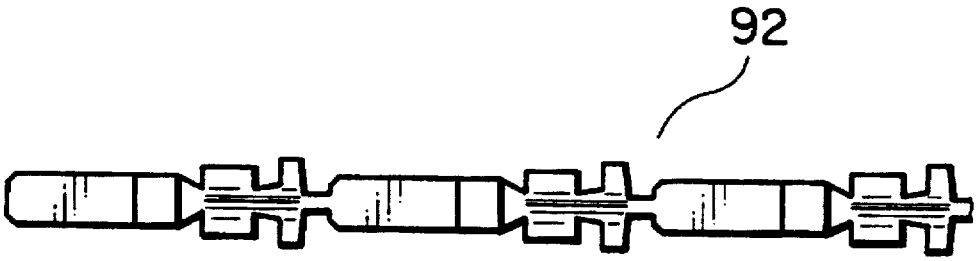

FIG. 4 is a front view of a crimping machine assembly C constituting the terminal crimping unit according to the present invention. FIG. 5 is a right side view partially broken in FIG. 4. FIG. 6 is a left side view of FIG. 4 where the anvil mounting stand is rotated by 90°. FIGS. 7A and 7B are plan views of the states where an anvil attaching stand has located on a terminal delivery position and a terminal crimping position, respectively.

The crimping machine assembly C includes a vertically movable ram assembly 25 equipped with a crimper 32 on its front face, an anvil 33 below the ram assembly 25, a terminal feed portion 37 located beside (left side in FIG. 4) the ram assembly 25, an anvil rotating means 60 for making reciprocative rotation of 90° of the anvil 33 between the terminal feed portion 37 and the ram assembly 25 (i.e. terminal delivery position and a terminal crimping position), a terminal cut/separation means, and a block 20 for mounting these members.

In FIG. 4, the mounting block 20 includes a base plate 21 and a stand plate 22 provided on its one side (right side in the figure). The stand plate 22 is provided with a ram guide block 23. On a longitudinal guide groove 24 of the ram guide block 23, the ram assembly 25 is vertically slidably mounted.

The ram assembly 25 includes a ram 26 and a head 27. To the head 27, an adjusting screw 29 with a pressing receiver 28 on its upper end is screwed together with a tightening nut 30. To a hooking block 31 protruding from the lower surface of the head 27, a mounting piece 32*a* at the upper end of the crimper is screwed. The lowest point (dead point) of the ram 26 (and hence the crimper 32) are so adapted that it can be finely adjusted.

Below the ram assembly 25, the anvil 33 opposite to the crimper 32 is removably mounted to an anvil mounting stand 34. Along the front surface of the anvil mounting stand 34, a coupling piece cutter 36 as well as a carrier guide plate 35 are vertically movably mounted through a spring (not shown).

The terminal feed portion 37 is located beside the ram assembly 25. The terminal feed portion as shown in FIG. 6, includes a terminal guide stand 38 on the rear side of the ram assembly 25, a holding cover 39 and a terminal sending-off finger 40. The terminal sending-off finger 40 is inclined on the outlet side of the carrier 2 of the side feed terminal chain 1 and is, at its tip, provided with a terminal feed piece 41 engaged with the terminal feed hole 7. The terminal guide stand 38 is fixed to the hooking block 42 provided on the base plate 21. The side feed terminal chain 1 is pushed onto the terminal guide stand 38 to prevent play by a terminal holder 44 mounted in a window 43*a* of bracket 43 attached on the front surface of the terminal guide stand 38.

On the side of the ram 26 opposite to the surface of the crimper 32, a plate cam 45 is fixed. The surface of the plate cam 45 is formed as a stepped engagement surface having a step between an upper vertical surface 45*a* far from a ram axis P and a lower vertical surface 45*c* near the ram axis P via an intermediate driving slope 45*b*.

The ram guide block 23 is provided with a side feed guide groove 46 orthogonal to the longitudinal guide groove 24 (FIG. 4) and also in parallel to the terminal feed stand 38. In the side feed groove a cam-follow bar 47 is mounted slidably in opposition to the crimper 32. The cam-follower bar 47 is provided with a cam-follower 48 to be engaged with the plate cam 45 at its intermediate position and with a driving bar 49 protruding form the end on the side of the terminal sending-off finger 40 so that it is always urged towards the crimper 32 by the spring 50. The driving bar 49 is extended to the bracket 51 provided beside the ram guide block 23, and its tip is supported by a bearing 52.

Between the brackets 51 and 51', the center portion of a swinging plate 53 is axially supported by a joint 49*a* at an intermediate position of the driving bar 49. The stem of the swinging plate 53 is axially supported by a fixed shaft 54. The upper end thereof is coupled with a terminal sending-off lever 56. The intermediate portion of the terminal sending-off lever 56 is rotatably attached to a positioning hole 57 by a bolt shaft 58, the positioning hole 57 is made as an inclined hole in the bracket 51'. The lower end of the terminal sending-off lever 56 is coupled with the terminal sending-off finger 40 by a pin 59.

The anvil rotating means 60, as shown in FIG. 5, includes a rotary disk 61 for supporting the anvil mounting stand 34 and a bolt (rotary shaft) 63 with a gear 62 at its intermediate position and a rack 64 engaged with the gear 62.

Specifically, the anvil mounting stand 34 is removably attached on the rotary disk 61 which is non-rotatably fixed on the head 63*a* of the bolt 63 pivoted on the base plate 21 through a rotary shaft collar 65. The rack 64 engaged with the gear 62 is coupled with a piston rod 67*a* of an air cylinder 67 fixed on the side of the stand plate 22 on the base plate 21.

The terminal cut/separation means 68, as shown in FIGS. 4 and 6, is provided with an actuator 69 on the side of the ram guide block 23, and with a cutter pressing piece 71 on the bottom of its piston rod 70. The cutter pressing piece 71, in cooperation with the coupling piece cutter 36 and carrier guide plate 35, cuts the coupling piece 3 of the side feed terminal chain 1. Further, as shown in FIG. 5, on the lower surface of the ram guide block 23, a piston rod serving as a terminal holding pin 74 is provided emergibly on the axial line of the bolt 63. Incidentally, reference numeral 75 denotes an air cylinder of the terminal holding pin 74.

The terminal crimping unit A hitherto described can be very easily assembled as follows.

In FIG. 2, the crimping machine assembly C is inserted into the unit case B from its front or rear opening. The pressing receiver 28 is fit in the joint member 15 of the air cylinder 13 which is previously fixed.

Although the crimping machine unit C is a device dedicated to the side feed terminal chain, the known device for vertical feed terminal chain can be coupled with the unit C using the joint 15 (FIG.6).

Thus, common use of the unit case B permits the terminal crimping unit A for the side feed terminal chain to be fabricated in entirely the same width and appearance as for the terminal crimping unit for vertical feed terminal chain. For this reason, as shown in FIG. 3, a large number of terminal crimping units can be arranged in a row so as to save the space for the configuration of the automatic terminal crimping device. Further, even after the terminal crimping units $A_1$, $A_2$, $A_3$, $A_4$, . . . are arranged in a row, a change of the arrangement or exchange into other crimping units having a similar structure can be easily done.

An explanation will be given of the operation of the terminal crimping unit A.

FIG. 6 and FIG. 7A show the state where the anvil mounting stand 34 and the anvil 33 are located at the front end of the terminal guide stand 38, i.e., terminal delivery position, and one terminal 4 is located on the anvil 33 as a result that the side feed terminal chain 1 has been intermittently fed. This state is referred to as "initial point".

At the initial point, the terminal holding pin 74 falls and the ⊃-shaped terminal holder 72 holds the terminal from both sides thereof to establish the posture of the terminal. As the piston rod 70 of the air cylinder 69 constituting the terminal cut/separation falls, it cuts the carrier 2. The coupling piece cutter 36, in cooperation with the cutter pressing piece 71 and the carrier guide plate 35, cuts the coupling piece 3. Thus the terminal 4 is separated from the carrier 2. The terminal holding pin 74 (FIG. 5) falls simultaneously with fall of the piston rod 70 and its tip holds the tip of the electrical contact portion 5 of the terminal 4. As a result, the terminal 4 is placed on the anvil 33 in a normal posture free from axis deviation and warp.

The anvil rotating means 60 rotates the anvil 33 on which the terminal 4 is placed, by 90°, i.e. shifts it to the terminal crimping position so that the wire connection portion 6 of the terminal 4 is located just below the crimper 32.

Specifically, in the state of FIG. 7A, the air cylinder 67 operates to retreat the rack 64 as indicated in arrow S so that the rotary disk 61 rotates by 90° counterclockwise as indicated by arrow T. FIG. 7B shows the state where the rotary disk 61 has rotated. During the rotation, the terminal 4 keeps its predetermined posture since it remains pressed on the anvil 33 by the terminal holder 74 having the same axial line as that of the bolt 63.

FIGS. 4 and 5 show the state where the terminal 4 is located on the terminal crimping position as result of the 90° rotation. In this state, when the air cylinder 13 (FIG. 2) operates to fall the ram assembly 25, the wire connection portion 6 of the terminal 4 placed on the anvil 33 is pressed by the crimper 32 so as to be crimped on the conductor portion of a wire (not shown).

Further, as shown in FIG. 6, the cam follower bar 47 having a cam follower 48 to be engaged with the plate cam 45, as the ram assembly 25 falls, is shifted towards the direction of arrow Q by the spring 50, i.e. the side of crimper 32. Then, the swinging plate 53 rotates clockwise around the fixed shaft 54 and the terminal sending-off lever 56 also rotates around the bolt shaft 58 so that the terminal sending-off finger 40 swings toward arrow R. As a result, the terminal feed piece 41 is retreated towards the side of the terminal guide stand 38 by one frame, i.e. a pitch between the terminal feed holes 7, 7.

In this state, when the ram assembly 26 rises as shown in FIG. 6, the cam follower 48 slides from the upper vertical face 45*a* of the plate cam 45 to the lower vertical face 45*c* via the driving slope 45*b*. Thus, the cam follower bar 47 moves towards the direction opposite to arrow Q in FIG. 6 by the degree of step or level difference between the upper vertical face 45*a* and the lower vertical face 45*c*. As a result, the terminal sending-off finger 40 swings towards the direction opposite to arrow R so that the piece 40 to be engaged with the terminal feed hole 7 feeds the side feed terminal chain 1 by one frame. Thus, the terminal 4 to be subsequently crimped sticks out from the terminal guide stand 38.

Additionally, the swing amount of the terminal sending-off finger 40, i.e., the moving amount of the side feed terminal 1 depends on the position of the bolt shaft 58 in the axis determining hole 57. As the bolt shaft 58 is moved from bottom to top in the shaft determining hole 57, the swing amount of the terminal sending-off finger decreases. This permits precise intermittent feed of the side feed terminal 1 in accordance with the pitch of the terminal feed holes 7, 7.

In the state where a single terminal 4 sticks out from the terminal guide stand 38, when the rotary disk 61 is reversely rotated by 90° from FIG. 7B to FIG. 7A to the manner described above, namely the terminal 4 is returned from the terminal crimping position to the terminal delivery position, the initial point state is recovered.

During the recover to the initial point state, since the anvil mounting stand 34 is provided with the carrier guide plate 35, the terminal 4 previously intermittently fed can be smoothly guided to the anvil 33.

Thus, one cycle of cut/separation, 90° rotation, terminal crimping and terminal feed of the terminal 4 is ended.

What is claimed is:

1. A terminal crimping machine assembly for a side feed terminal chain composed of terminals connected at a predetermined pitch through coupling pieces on one side of a carrier strip, comprising:

a mounting block provided with a base plate;

an anvil provided on anvil mounting stand on the base plate;

a ram assembly arranged vertically movably above said anvil and provided with a crimper on its front surface;

a terminal feed portion for intermittently feeding said side feed terminal chain, located beside said ram assembly;

an anvil rotating means for reciprocatively rotating said anvil mounting stand between a terminal crimping position below said ram assembly and a terminal delivery position at the tip of said terminal feed portion; and a cut/separation means, located above said terminal delivery position, for separating an individual terminal from said side feed terminal chain intermittently fed.

2. A terminal crimping machine assembly according to claim 1, further comprising a ram guide block, attached to a stand plate provided on one side of said mounting block, for vertically slidably mounting said ram assembly.

3. A terminal crimping machine assembly according to claim 1, wherein said anvil rotating means comprises:

a rotary disk for supporting said anvil rotating means;

a rotary shaft with an upper end connected to said rotary disk, a lower end rotatably pivoted on the base plate of said mounting block and a gear mounted at its intermediate position; and a rack engaged with said gear so as to move forward and backward by an operation of an actuator.

4. A crimping machine assembly according to claim 1, further comprising a terminal holder arranged on said ram assembly, which can float on said rotary shaft.

5. A crimping machine assembly according to claim 1, wherein said terminal feed portion includes a terminal feed piece to be engaged with terminal feed holes of the carrier of said side feed terminal chain, and said terminal feed piece moves back and forth in linkage with rise or fall of said ram assembly.

6. A crimping machine assembly according to claim 1, wherein said cut/separation means includes an actuator located beside the ram assembly and a terminal holder attached to the tip of a piston rod of said actuator.

7. A terminal crimping unit comprising a unit case and a crimping machine assembly removably as set forth in claim 1 mounted in said unit case, wherein said unit case includes a bottom plate, side plates of said bottom plate, a top plate to which an actuator is attached, said actuator being equipped with a joint member at the lower end of a piston rod, the ram assembly of said crimping machine assembly is provided with a pressing receiver at its upper end; and said joint member of said unit case is engaged with said pressing receiver so that said unit case is coupled with said crimping machine assembly.

8. A crimping machine according to claim 1, wherein it is used as each of crimping machines constituting an automatic terminal crimping machine in which a plurality of wirings arranged in parallel at a predetermined interval oppositely to the crimping machines are moved, and the wirings are crimped when they reach desired crimping machines.

9. A crimping machine according to claim 7, wherein it is used as each of crimping machines constituting an automatic terminal crimping machine in which a plurality of wirings arranged in parallel at a predetermined interval oppositely to the crimping machines are moved, and the wirings are crimped when they reach desired crimping machines.

* * * * *